US009234719B1

(12) United States Patent
Kempf

(10) Patent No.: US 9,234,719 B1
(45) Date of Patent: Jan. 12, 2016

(54) SHOOTING BOW WITH PULLEYS

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 0 days.

(21) Appl. No.: 14/495,919

(22) Filed: Sep. 25, 2014

(51) Int. Cl.
*F41B 5/12* (2006.01)
*F41B 5/10* (2006.01)

(52) U.S. Cl.
CPC ..... *F41B 5/123* (2013.01); *F41B 5/105* (2013.01); *F41B 5/12* (2013.01)

(58) Field of Classification Search
CPC ..... F41B 5/10; F41B 5/105; F41B 5/12; F41B 5/123
USPC ..... 124/25, 25.6, 900
See application file for complete search history.

(56) References Cited

U.S. PATENT DOCUMENTS 3,809,048 A * 5/1974 Handford ..... F41B 5/123 124/25
3,854,467 A * 12/1974 Hofmeister ..... F41B 5/105 124/25.6
3,987,777 A * 10/1976 Darlington ..... F41B 5/105 124/25.6
4,077,385 A * 3/1978 Fredrickson ..... F41B 5/10 124/25.6
4,169,456 A * 10/1979 Van House ..... F41B 5/12 124/25
4,287,867 A * 9/1981 Islas ..... F41B 5/10 124/25.6
4,457,288 A * 7/1984 Ricord ..... F41B 5/10 124/25.6
4,461,267 A * 7/1984 Simonds ..... F41B 5/10 124/25.6
4,562,824 A * 1/1986 Jennings ..... F41B 5/105 124/25.6
4,649,890 A * 3/1987 Powers ..... F41B 5/105 124/25.6
4,649,891 A * 3/1987 Bozek ..... F41B 5/123 124/25
4,667,649 A * 5/1987 Humphrey ..... F41B 5/10 124/25.6
4,683,865 A * 8/1987 Troncoso ..... F41B 5/105 124/25.6
4,722,317 A * 2/1988 Hartwig ..... F41B 5/10 124/25.6
4,757,799 A * 7/1988 Bozek ..... F41B 5/10 124/25.6
4,766,874 A * 8/1988 Nishioka ..... F41B 5/12 124/25

(Continued)

*Primary Examiner* — Alexander Niconovich
(74) *Attorney, Agent, or Firm* — Donald J. Ersler

(57) ABSTRACT

A shooting bow includes pulleys, a string latch housing, bow riser, barrel, first limb, second limb, a first cam, and a second cam. The bow riser is enjoined with the barrel. The first and second limbs extend from the bow riser. The first and second cams are pivotally retained on the first and second limbs. A bowstring is retained by the first and second cams. A first pulley and a second pulley are retained on the barrel. Both cams have a string track and a cable track. One end of the string is coupled to the first cam and the other end is coupled to the second cam. As for both cables, one end is coupled to the first cam, the middle of the cable travels around a pulley or track, and the other end is coupled to the first limb, first cam axle or back to the cam.

23 Claims, 10 Drawing Sheets

(56) References Cited

U.S. PATENT DOCUMENTS 4,817,580 A * 4/1989 Butterfield ..... F41B 5/105 124/25.6
4,858,588 A * 8/1989 Bozek ..... F41B 5/10 124/23.1
4,879,987 A * 11/1989 Nishioka ..... F41B 5/123 124/25
4,917,071 A * 4/1990 Bozek ..... F41B 5/12 124/24.1
5,024,206 A * 6/1991 Lester ..... F41B 5/0094 124/23.1
5,054,463 A * 10/1991 Colley ..... F41B 5/10 124/25.6
5,388,564 A * 2/1995 Islas ..... F41B 5/0094 124/23.1
5,535,727 A * 7/1996 Helmuth ..... F41B 5/10 124/25.6
5,630,405 A * 5/1997 Nizov ..... F41B 5/123 124/25
5,678,528 A * 10/1997 Hadley ..... F41B 5/12 124/24.1
5,950,609 A * 9/1999 Thielen ..... F41B 5/10 124/25.6
6,067,974 A * 5/2000 Islas ..... F41B 5/0094 124/25.6
6,076,512 A * 6/2000 Thielen ..... F41B 5/10 124/25.6
6,098,607 A * 8/2000 Strother ..... F41B 5/10 124/25.6
6,776,148 B1 * 8/2004 Islas ..... F41B 5/10 124/25.6
6,792,931 B1 * 9/2004 Schaar ..... F41B 5/10 124/25.6
7,047,958 B1 * 5/2006 Colley ..... F41B 5/105 124/25.6
7,328,693 B2 * 2/2008 Kempf ..... F41B 5/123 124/25
7,578,289 B2 * 8/2009 Norkus ..... F41B 5/0094 124/25
7,637,256 B2 * 12/2009 Lee ..... F41B 5/105 124/25.6
7,823,572 B2 * 11/2010 Anderson ..... F41B 5/123 124/25
7,891,348 B2 * 2/2011 Colley ..... F41B 5/105 124/25
7,938,108 B2 * 5/2011 Popov ..... F41B 5/123 124/25
8,037,876 B1 * 10/2011 Yehle ..... F41B 5/10 124/25.6
8,136,514 B2 * 3/2012 Howard ..... F41B 5/0094 124/1
8,387,603 B2 * 3/2013 Darlington ..... F41B 5/10 124/23.1
8,387,604 B1 * 3/2013 Terzo ..... F41B 5/10 124/23.1
8,522,762 B2 * 9/2013 Trpkovski ..... F41B 5/0094 124/23.1
8,578,918 B1 * 11/2013 Islas ..... F41B 5/123 124/25
8,651,095 B2 * 2/2014 Islas ..... F41B 5/105 124/25
8,826,894 B1 * 9/2014 Darlington ..... F41B 5/105 124/25
8,893,694 B1 * 11/2014 DeBole ..... F41B 5/0094 124/25.6
8,899,217 B2 * 12/2014 Islas ..... F41B 5/105 124/25.6
8,919,332 B2 * 12/2014 Trpkovski ..... F41B 5/0094 124/23.1
8,991,375 B2 * 3/2015 McPherson ..... F41B 5/123 124/24.1
2008/0251058 A1 * 10/2008 Colley ..... F41B 5/105 124/25
2011/0041820 A1 * 2/2011 Stanziale ..... F41B 5/105 124/25
2011/0056467 A1 * 3/2011 Popov ..... F41B 5/0094 124/25.6
2012/0125302 A1 * 5/2012 Stanziale ..... F41B 5/123 124/25
2014/0261360 A1 * 9/2014 Pulkrabek ..... F41B 5/1469 124/35.2
2015/0285581 A1 * 10/2015 Chang ..... F41B 5/123 124/25

* cited by examiner

SHOOTING BOW WITH PULLEYS

BACKGROUND OF THE INVENTION

1. Field of the Invention

The present invention relates generally to archery and more specifically to a shooting bow with pulleys, which allows a power end of first and second cables to be coupled to first and second cams and a control end to be coupled back to first and second limbs.

2. Discussion of the Prior Art

Historically, archery bows and crossbows have been used for war, survival, sport, and recreation. A specific component of a compound style shooting bow are the cables. Each cable includes a power end and a control end. The manner in which the cables interact with the cams and limbs of the bow is of particular importance. Typically, the power end of the cable is coupled to the cam on one limb, and the control end of the cable is often coupled to the opposite limb or opposite cam. A very good way to accomplish efficiency is through a binary cam system, wherein the cables are connected to opposing cams, and as one of the cams wraps the cable on the power track, the opposite cam pays out cable from the control track. While all of these methods work to some extent, all have significant issues with performance and/or assembly and cost. Due to crossing cables and the need to keep the cables from interfering with the flight of the arrow, the cables often are off-angle, which in turn creates twisting and torque, thus tipping the cams.

U.S. Pat. No. 4,457,288 to Ricord discloses a cam lever compound bow, where a bow utilizes single string wrapping pulleys journaled to the ends of the bow limbs, and the ends of the string are coupled to a cam device mounted upon the bow riser. Although, this method does remove the problem of the cables being in the way, it is very inefficient, and timing issues from one limb to the other is a factor. U.S. Pat. No. 7,637,256 to Lee discloses a compound bow, which provides a shooting bow that removes the issue of cables interfering with the flight of the arrow. However the inefficient use of tensioning devices severely limits the potential of this device. U.S. Pat. No. 8,651,095 to Islas discloses a bowstring cam arrangement for compound crossbow, which provides a method of removing the cables from the path of the string. However, issues are created by having cables above and below the string track on each cam.

The above inventions are trying to keep four cables in proper timing, as opposed to two, and there is no provision to payout cable to wrap on the cable power groove of the cam. By not allowing for payout on the power groove, the limb must deflect a distance equal to a distance that the power cable is wrapping on the cam. The present invention deals with the manner in which the cables are coupled to the cams and the limbs of the bow or crossbow.

Accordingly, there is a clearly felt need in the art to provide a shooting bow with pulleys, which allows a power end of first and second cables to be coupled to first and second cams and a control end to be coupled back to first and second limbs, respectively.

SUMMARY OF THE INVENTION

The present invention provides a shooting bow with pulleys, which allows a power end of first and second cables to be coupled to first and second cams and a control end to be coupled back to first and second limbs. The shooting bow with pulleys preferably includes a string latch housing, a bow riser, a barrel, a first limb, a second limb, a first cam, a second cam and at least one bowstring. The bow riser is enjoined with the barrel. One end of the first limb extends from a first end of the bow riser and one end of the second limb extends from a second end of the bow riser. The first cam is pivotally retained in the distal end of the first limb and the second cam is pivotally retained in the distal end of the second limb. A first end of the bowstring is retained by the first cam and a second end of the bowstring is retained by the second cam. A first pulley is pivotally retained on a first side of the barrel. A second pulley is pivotally retained on a second side of the barrel. Alternatively, the first and second pulleys may be attached to a cable hub. The cable hub may be rigidly attached to the barrel or slidably retained on the barrel. The first and second pulleys may also be replaced with first and second semi-circular tracks.

The first cam includes a first cam string track and at least one first cam cable track; and the second cam includes a second cam string track and at least one second cam cable track. A first end (power end) of the first cable is coupled to the first cam and at least a portion of the first cable is retained in the cable track of the first cam. Substantially a middle of the first cable is retained around the first pulley or first semi-circular track; and a second end (control end) of the first cable is coupled to the first limb. A first end of the second cable is coupled to the second cam and at least a portion of the second cable is retained in the cable track of the second cam. Substantially a middle of the second cable is retained around the second pulley or second semi-circular track; and a second end of the second cable is coupled to the second limb. Alternatively, the second end of the first cable is coupled to the first cam and the second end of the second cable is coupled to the second cam, as in a binary cam configuration. Further, the second end of the first cable could be coupled to an axle of the first cam and the second end of the second cable coupled to an axle of the second cam. For clarity, the word coupled is being defined as a way to connect an end of a bowstring or cable to another object, be it directly or indirectly, such as directly to a post or pulley, or indirectly as in from the end of a string or cable, to an intermediate object, and then to a limb or axle.

Accordingly, there is a clearly felt need in the art for a shooting bow with pulleys, which allows a power end of first and second cables to be coupled to first and second cams and a control end to be coupled back to first and second limbs, respectively.

These and additional objects, advantages, features and benefits of the present invention will become apparent from the following specification.

DETAILED DESCRIPTION OF THE PREFERRED EMBODIMENTS

Figure 1:
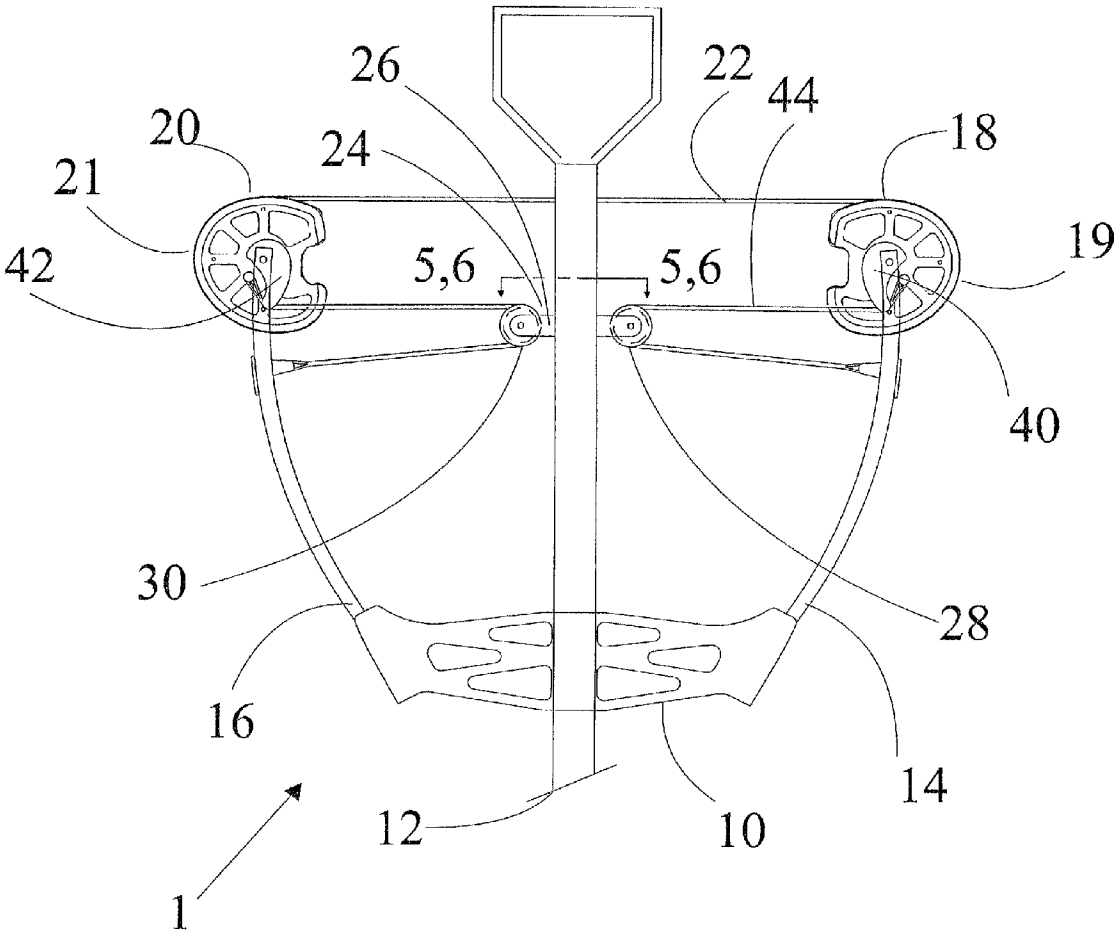
FIG. 1 is a bottom view of a reverse limb crossbow with a bowstring, a first bow limb and a second bow limb at rest in accordance with the present invention.
Figure 1A:
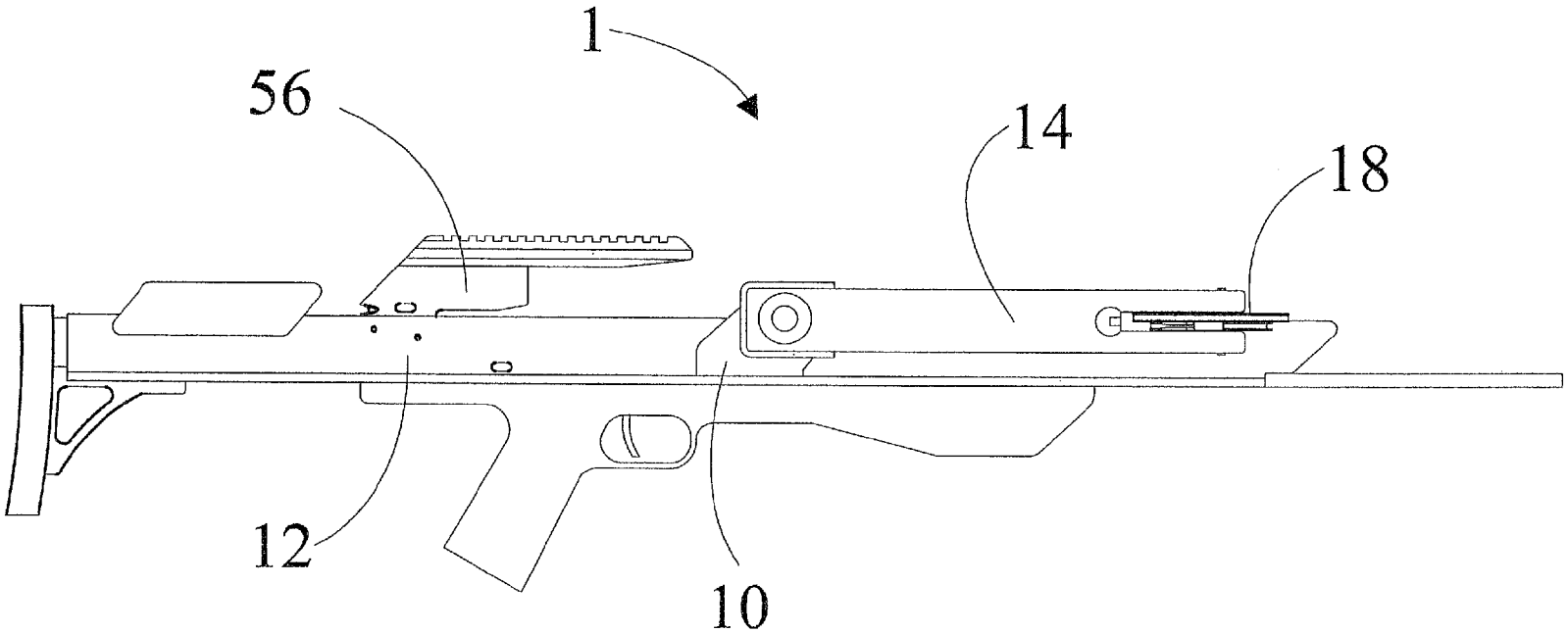
FIG. 1A is a side view of a reverse limb crossbow showing a stock, string latch housing, and bow assembly in accordance with the present invention.
Figure 2:
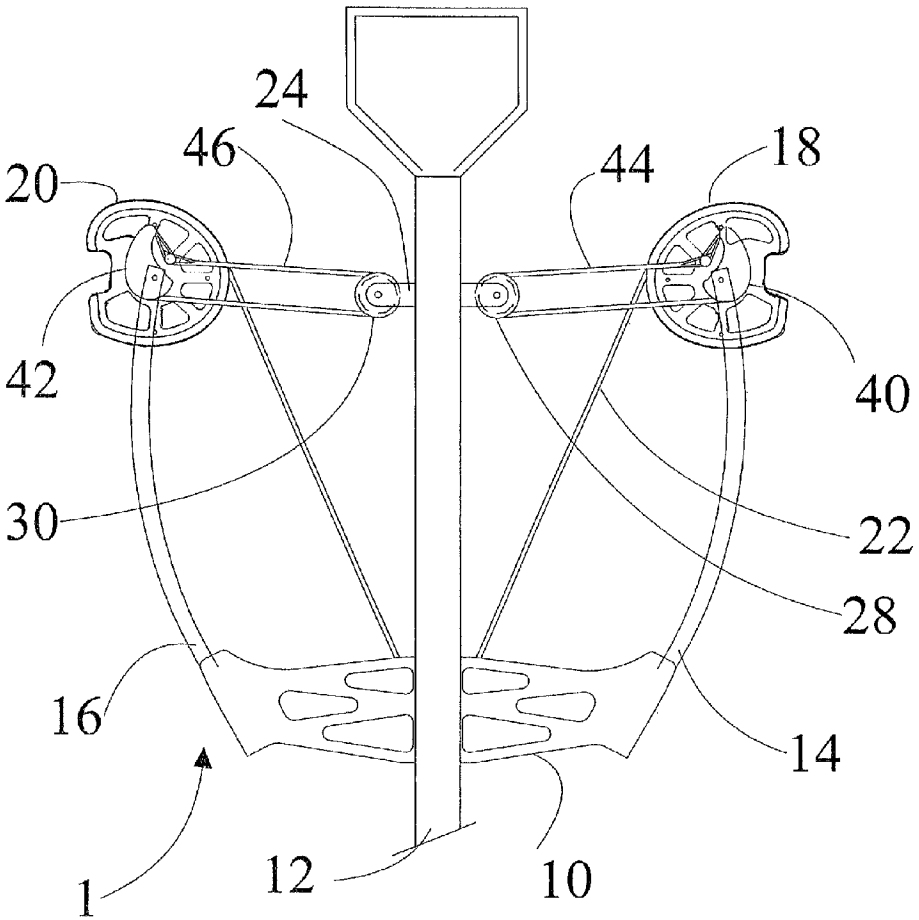
FIG. 2 is a bottom view of a reverse limb crossbow with a bowstring, a first bow limb and a second bow limb partially drawn in accordance with the present invention.
Figure 6:
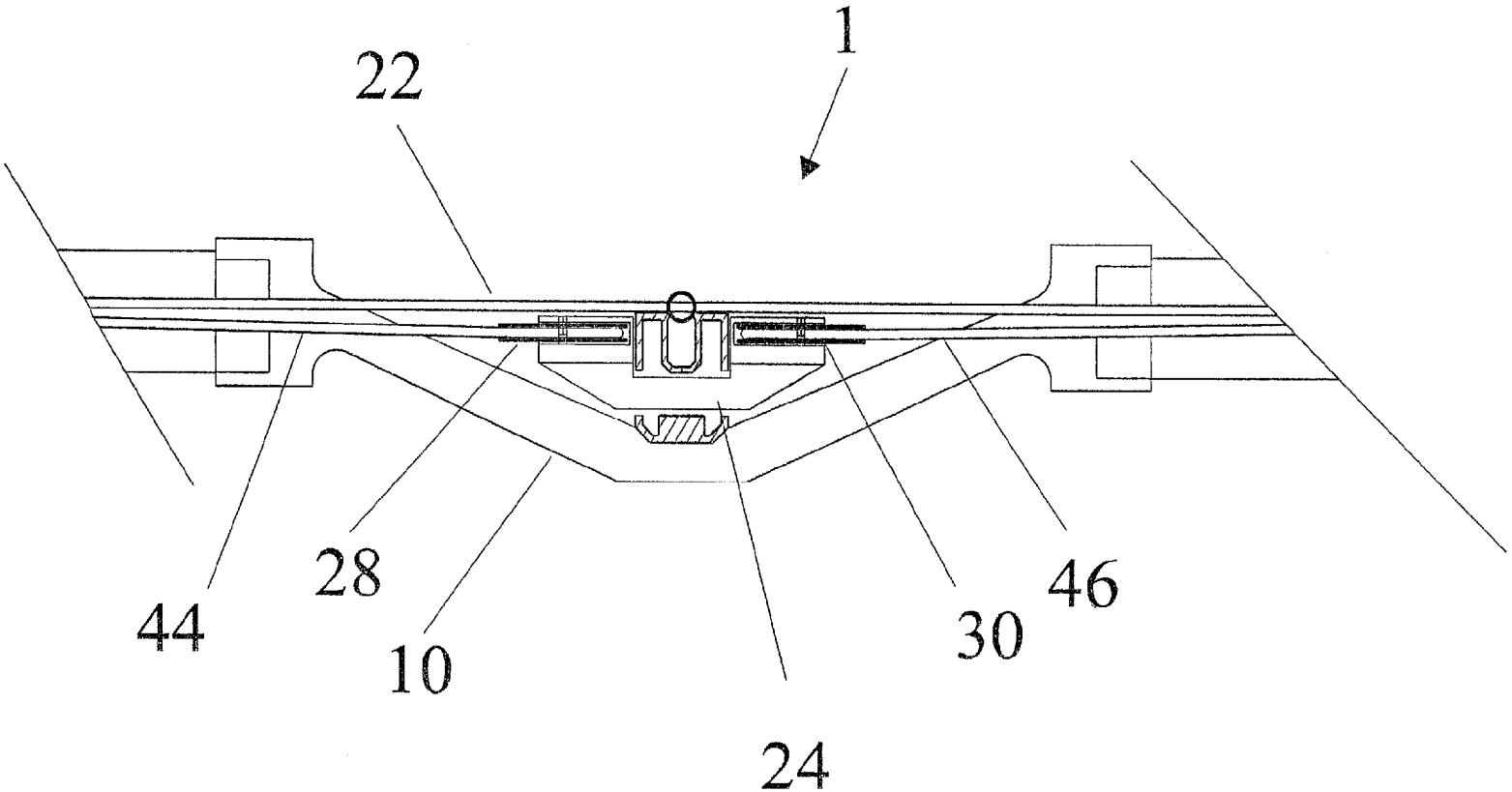
FIG. 6 is a front cross sectional view of a reverse limb crossbow with a cable hub slidably engaged with a barrel and the cable hub having two pulleys in accordance with the present invention.
Figure 7:
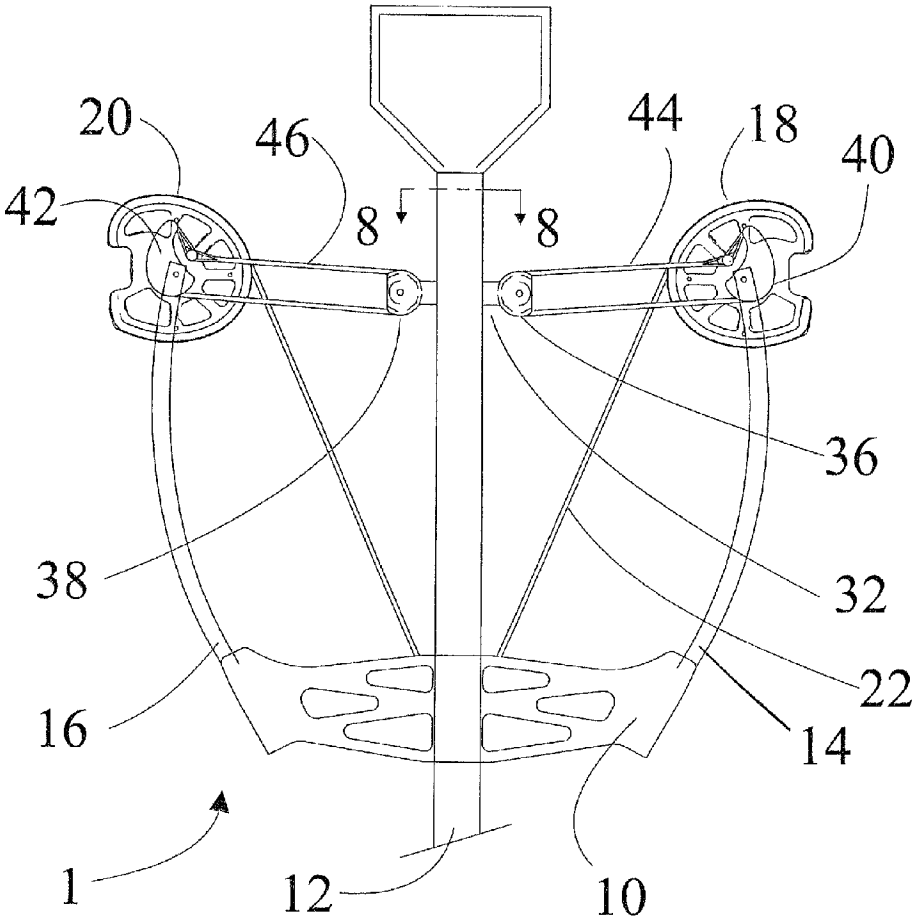
FIG. 7 is a bottom view of a reverse limb crossbow with a fixed cable track instead of a pulley and a bowstring, a first bow limb and a second bow limb drawn in accordance with the present invention.
Figure 8:
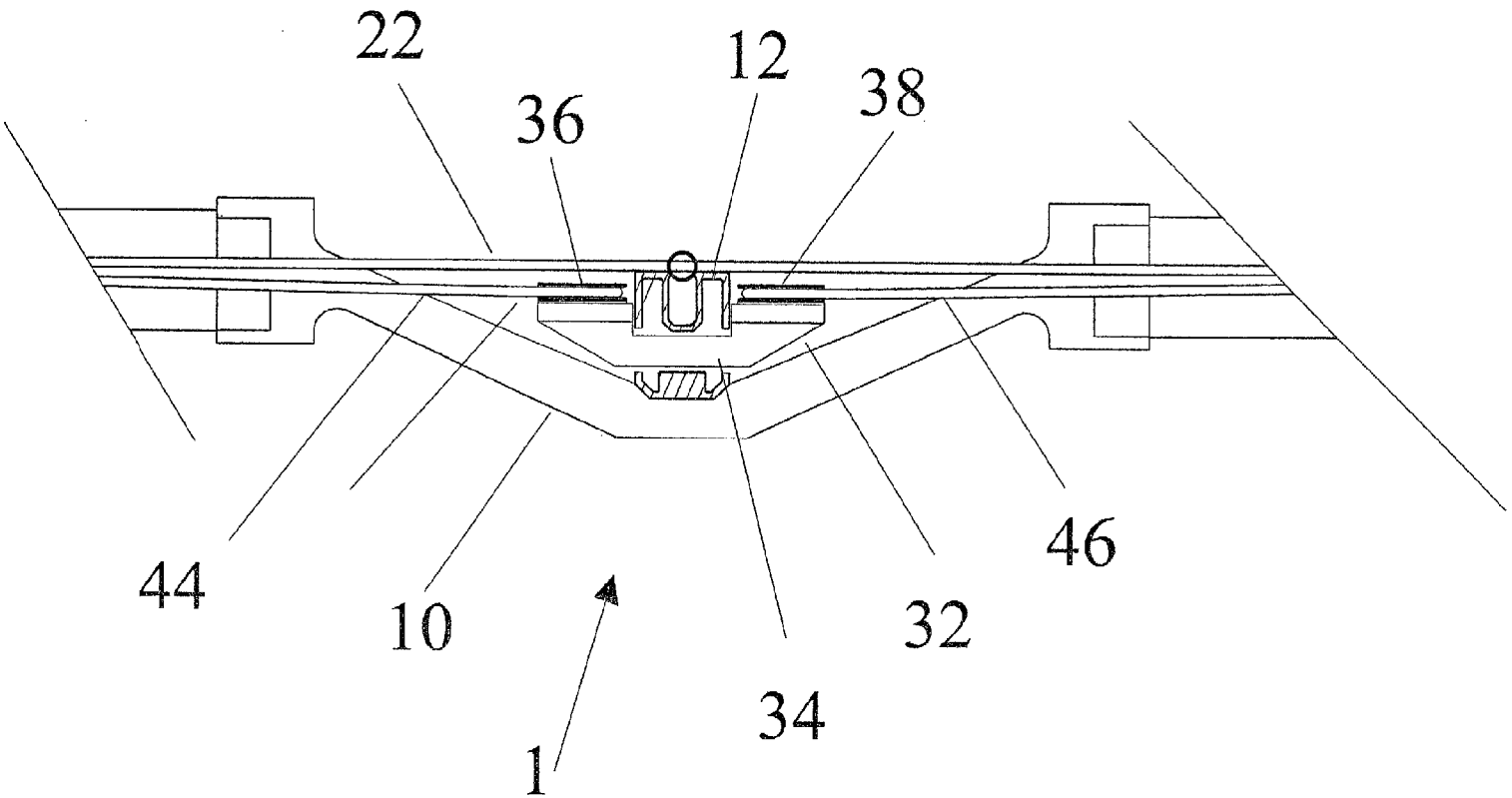
FIG. 8 is a front cross sectional view of a reverse limb crossbow with a cable hub slidably engaged with a barrel and the cable hub having cable tracks in accordance with the present invention.

With reference now to the drawings, and particularly to FIG. 1, there is shown a bottom view of a shooting bow with pulleys 1. With reference to FIGS. 2-6, the shooting bow with pulleys 1 preferably includes a bow riser 10, a barrel 12, a first limb 14, a second limb 16, a first cam 18, a second cam 20 and at least one bowstring 22. The bow riser 10 is enjoined with the barrel 12 in any method known to join two pieces, as well as the barrel and riser being formed as a single unit. One end of the first limb 14 extends from a first end of the bow riser 10 and one end of the second limb 16 extends from a second end of the bow riser 10. The first cam 18 is pivotally retained in the distal end of the first limb 14 and the second cam 20 is pivotally retained in the distal end of the second limb 16. A first end of the bowstring 22 is retained by the first cam 18 and a second end of the bowstring 22 is retained by the second cam 20. A cable hub 24 includes a cable hub body 26, a first pulley 28 and a second pulley 30. The first pulley 28 is rotatably retained on a first side of the cable hub body 26 and the second pulley 30 is rotatably retained on a second side of the cable hub body 26. The cable hub body 26 is attached to the barrel 12. With reference to FIG. 6, the cable hub 24 may be slidably engaged with the barrel 12. With reference to FIGS. 7-8, a cable hub 32 includes a cable hub body 34, a first semi-circular cable track 36 and a second semi-circular cable track 38.

Figure 3:
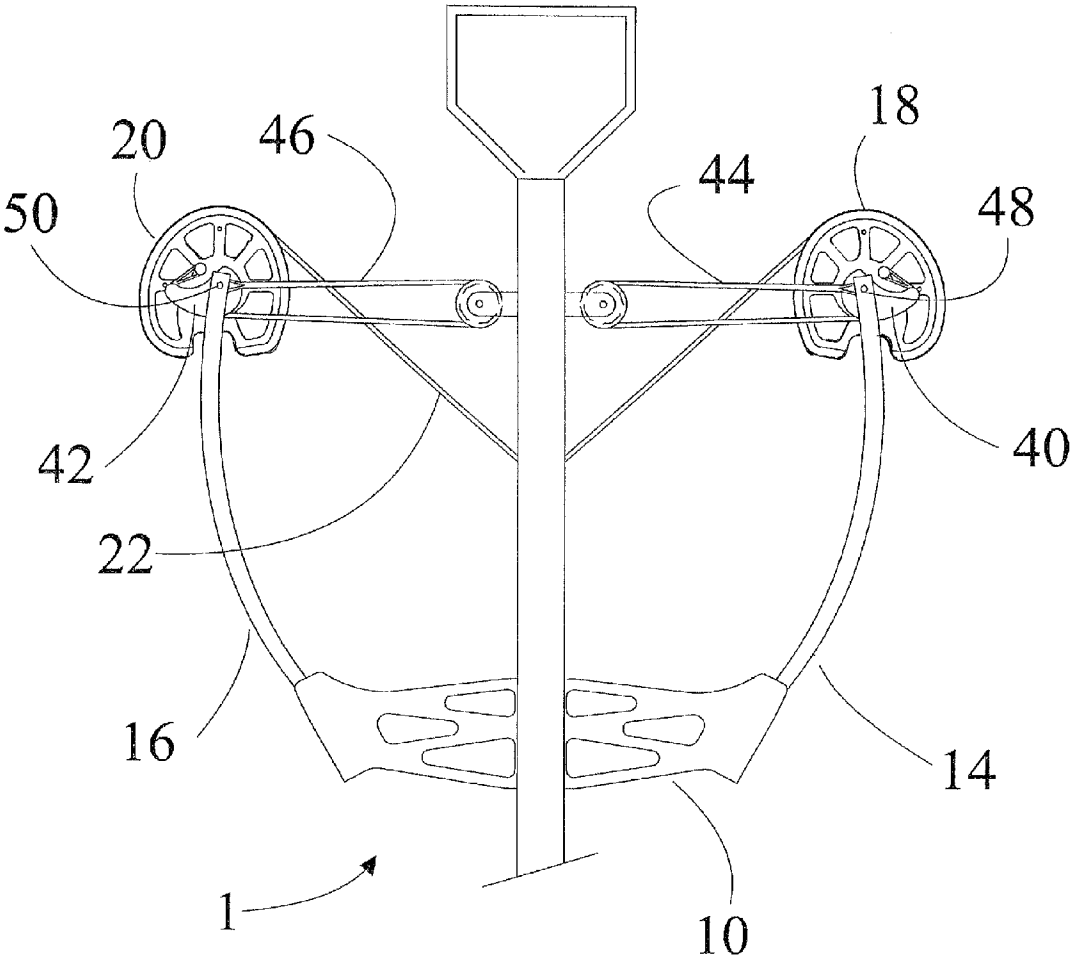
FIG. 3 is a bottom view of a reverse limb crossbow with one end of first and second cables attached to first and second cable tracks and the other end attached to axles of the first and second cams in accordance with the present invention.
Figure 3A:
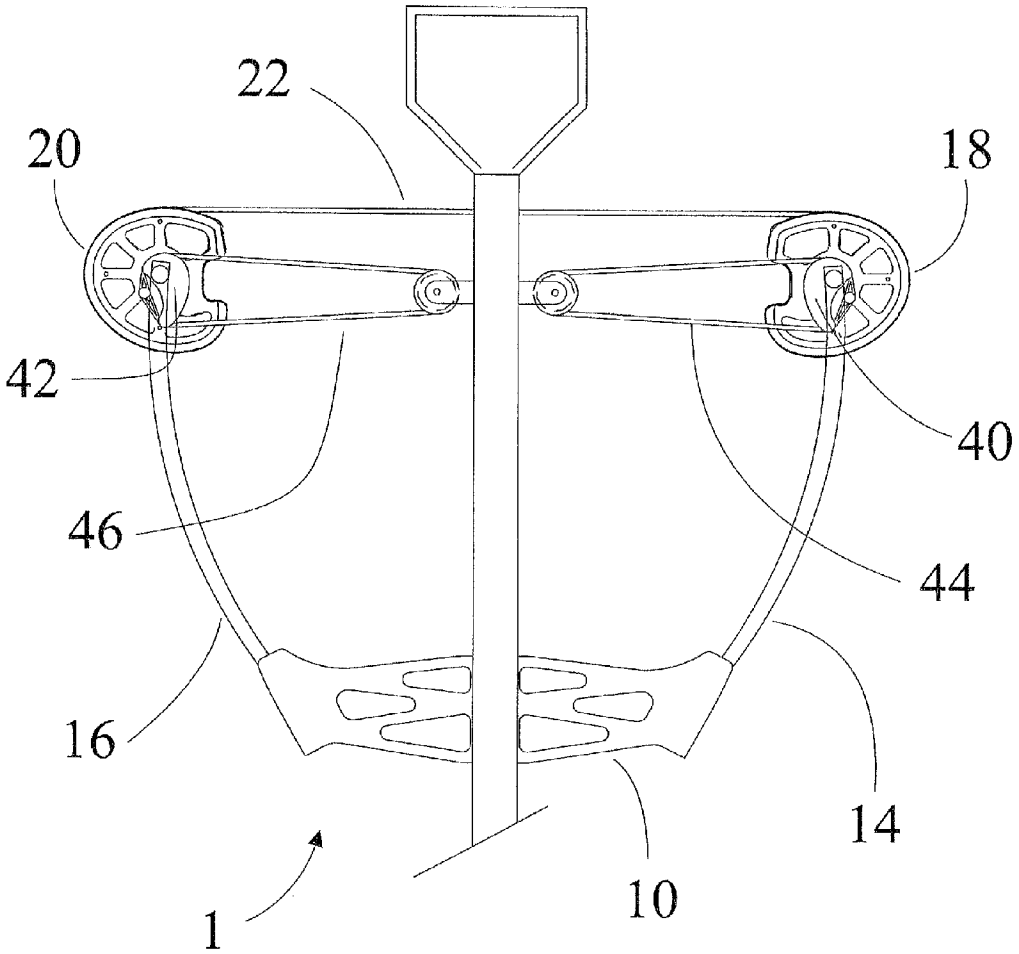
FIG. 3*a* is a bottom view of a reverse limb crossbow with both ends of first and second cables coupled to first and second cams in accordance with the present invention.
Figure 4:
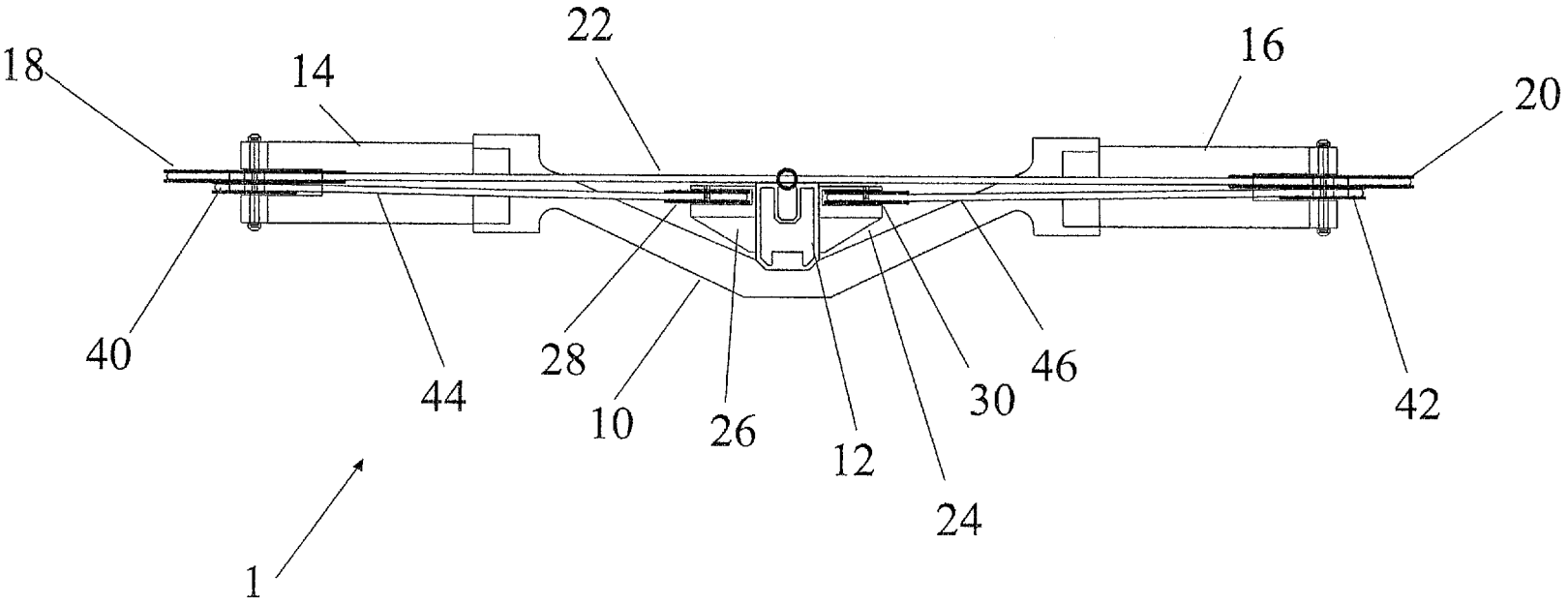
FIG. 4 is a front view of a reverse limb crossbow with a bowstring, a first bow limb and a second bow limb at rest in accordance with the present invention.
Figure 5:
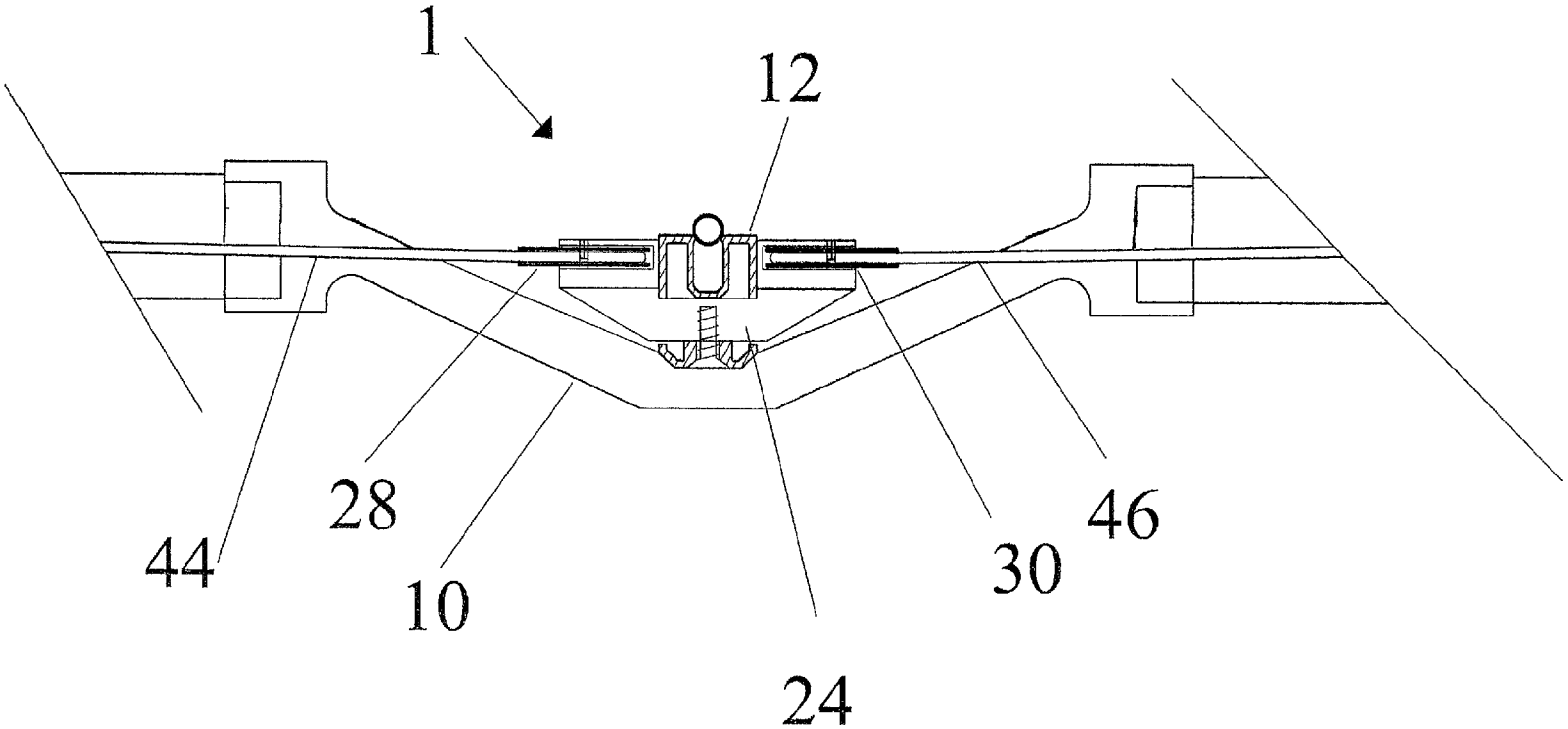
FIG. 5 is a front cross sectional view of a reverse limb crossbow with a cable hub secured to a barrel in accordance with the present invention.

The first cam 18 includes a first cam track 40 and the second cam 20 includes a second cam track 42. A first end (power end) of a first cable 44 is retained by the first cam track 40; substantially a middle of the first cable 44 is retained around the first pulley 28 or first semi-circular track 36; and a second end of the first cable 44 is secured to the first limb 14. A first end (power end) of a second cable 46 is retained by the second cam track 42; substantially a middle of the second cable 46 is retained around the second pulley 30 or second semi-circular track 38; and a second end of the second cable 46 is secured to the second limb 16. With reference to FIGS. 3-3*a*, a second end of the first cable 44 may be attached to a first axle 48 of the first cam 18 or to the first cam track 40. A second end of the second cable 46 may be attached to a second axle 50 or to the second cam track 42. A latch 56 for retaining the bow string 22 in a cocked position is engaged with the barrel 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A shooting bow with pulleys comprising:

a barrel having an elongated length, a first side, a second side and a centerline;

a bow riser having a first end and a second end, said bow riser is attached to said barrel;

a first limb having one end extending from said first end of saw bow riser;

a second limb having one end extending from said second end of said bow riser;

a first cam includes a first cam track, said first cam is pivotally retained on the other end of said first limb;

a second cam includes a second cam track, said second cam is pivotally retained on the other end of said second limb;

a bow string is retained by said first and second cams;

a first cable having one end retained by said first cam track, substantially a middle of said first cable is retained relative to said first side of said barrel without crossing said centerline of said barrel, the other end of said first cable is coupled to said first limb;

a second cable having one end retained by said second cam track, substantially a middle of said second cable is retained relative to said second side of said barrel without crossing said centerline of said barrel, the other end of said second cable is coupled to said second limb; and wherein said bow string is located forward said bow riser when said bow string is at rest.

2. The shooting bow with pulleys of claim 1, further comprising:

a first pulley is pivotally retained relative to said barrel, said first pulley engages said first cable, a second pulley is pivotally retained relative to said barrel, said second pulley engages said second cable.

3. The shooting bow with pulleys of claim 2, further comprising:

a cable hub pivotally retains said first pulley and said second pulley, said cable hub is attached to said barrel.

4. The shooting bow with pulleys of claim 2, further comprising:

a cable hub pivotally retains said first pulley and said second pulley, said cable hub is slidably retained on said barrel.

5. The shooting bow with pulleys of claim 1, further comprising:

a first substantially semi-circular cable track is retained relative to said barrel, said first semi-circular cable track engages said first cable, a second semi-circular cable track engages said second cable.

6. The shooting bow with pulleys of claim 5, further comprising:

said first and second substantially semi-circular cable tracks are retained on a cable hub, said cable hub is attached to said barrel.

7. The shooting bow with pulleys of claim 5, further comprising:

said first and second substantially semi-circular cable tracks are retained on a cable hub, said cable hub is slidably retained on said barrel.

8. The shooting bow with pulleys of claim 1 wherein:

a latch for retaining said bow string in a cocked position is engaged with said barrel.

9. A shooting bow with pulleys comprising:

a barrel having an elongated length, a first side, a second side and a centerline;

a bow riser having a first end and a second end, said bow riser is attached to said barrel;

a first limb having one end extending from said first end of saw bow riser;

a second limb having one end extending from said second end of said bow riser;

a first cam includes a first cam track, said first cam is pivotally retained on the other end of said first limb;

a second cam includes a second cam track, said second cam is pivotally retained on the other end of said second limb;

a bow string is retained by said first and second cams;

a first cable having both ends retained by said first cam, substantially a middle of said first cable is retained relative to said first side of said barrel without crossing said centerline of said barrel;

a second cable having both ends retained by said second cam, substantially a middle of said second cable is retained relative to said second side of said barrel without crossing said centerline of said barrel; and wherein said bow string is located forward said bow riser when said bow string is at rest.

10. The shooting bow with pulleys of claim 9, further comprising:

a first pulley is pivotally retained relative to said barrel, said first pulley engages said first cable, a second pulley is pivotally retained relative to said barrel, said second pulley engages said second cable.

11. The shooting bow with pulleys of claim 10, further comprising:

a cable hub pivotally retains said first pulley and said second pulley, said cable hub is attached to said barrel.

12. The shooting bow with pulleys of claim 10, further comprising:

a cable hub pivotally retains said first pulley and said second pulley, said cable hub is slidably retained on said barrel.

13. The shooting bow with pulleys of claim 9, further comprising:

a first substantially semi-circular cable track is retained relative to said barrel, said first semi-circular cable track engages said first cable, a second semi-circular cable track engages said second cable.

14. The shooting bow with pulleys of claim 13, further comprising:

said first and second substantially semi-circular cable tracks are retained on a cable hub, said cable hub is attached to said barrel.

15. The shooting bow with pulleys of claim 13, further comprising:

said first and second substantially semi-circular cable tracks are retained on a cable hub, said cable hub is slidably retained on said barrel.

16. The shooting bow with pulleys of claim 9 wherein:

a latch for retaining said bow string in a cocked position is engaged with said barrel.

17. A shooting bow with pulleys comprising:

a barrel having an elongated length, a first side, a second side and a centerline;

a bow riser having a first end and a second end, said bow riser is attached to said barrel;

a first limb having one end extending from said first end of saw bow riser;

a second limb having one end extending from said second end of said bow riser;

a first cam includes a first cam track, said first cam is pivotally retained on the other end of said first limb with a first axle;

a second cam includes a second cam track, said second cam is pivotally retained on the other end of said first limb with a second axle;

a bow string is retained by said first and second cams;

a first cable having one end retained by said first cam track, substantially a middle of said first cable is retained relative to said first side of said barrel without crossing said centerline of said barrel, the other end of said first cable is coupled to said first axle;

a second cable having one end retained by said second cam track, substantially a middle of said second cable is slidably retained relative to said second side of said barrel without crossing said centerline of said barrel, the other end of said second cable is coupled to said second axle; and wherein said bow string is located forward said bow riser when said bow string is at rest.

18. The shooting bow with pulleys of claim 17, further comprising:

a first pulley is pivotally retained relative to said barrel, said first pulley engages said first cable, a second pulley is pivotally retained relative to said barrel, said second pulley engages said second cable.

19. The shooting bow with pulleys of claim 17, further comprising:

a cable hub pivotally retains said first pulley and said second pulley, said cable hub is attached to said barrel.

20. The shooting bow with pulleys of claim 17, further comprising:

a cable hub pivotally retains said first pulley and said second pulley, said cable hub is slidably retained on said barrel.

21. The shooting bow with pulleys of claim 17, further comprising:

a first substantially semi-circular cable track is retained relative to said barrel, said first semi-circular cable track engages said first cable, a second semi-circular cable track engages said second cable.

22. The shooting bow with pulleys of claim 21, further comprising:

said first and second substantially semi-circular cable tracks are retained on a cable hub, said cable hub is one of attached to said barrel and slidably retained on said barrel.

23. The shooting bow with pulleys of claim 17 wherein:

a latch for retaining said bow string in a cocked position is engaged with said barrel.

* * * * *

UNITED STATES PATENT AND TRADEMARK OFFICE

CERTIFICATE OF CORRECTION

PATENT NO. : 9,234,719 B1
APPLICATION NO. : 14/495919
DATED : January 12, 2016
INVENTOR(S) : Kempf et al.

It is certified that error appears in the above-identified patent and that said Letters Patent is hereby corrected as shown below:

Title Page, Item (12) delete "Kempf" and insert --Kempf et al.--.

Title Page, Item (72) Inventor, should read

--(72) Inventors: James J. Kempf, Coralville, IA (US); Rex E. Isenhower, Stanwood, IA (US)--.

Signed and Sealed this
Twenty-first Day of June, 2016

Michelle K. Lee

Michelle K. Lee
*Director of the United States Patent and Trademark Office*